US005974941A

United States Patent [19]

Kushnir et al.

[11] Patent Number: 5,974,941

[45] Date of Patent: Nov. 2, 1999

[54] SEMI-AUTOMATIC REVOLVER

[76] Inventors: Yakov Kushnir; Leonid Kushnir, both of 65 Oriental Blvd., Brooklyn, N.Y. 11235

[21] Appl. No.: 08/949,554

[22] Filed: Oct. 14, 1997

[51] Int. Cl.[6] ..... F41A 5/06

[52] U.S. Cl. ..... 89/155; 89/160; 89/33.03; 42/65; 42/78; 42/39.5

[58] Field of Search ..... 89/155, 156, 157, 89/160, 161, 33.03, 159, 163; 42/65, 78, 39.5

[56] References Cited

U.S. PATENT DOCUMENTS

| | | | |
|---|---|---|---|
| 2,248,015 | 7/1941 | Whiting | 89/161 |
| 2,835,171 | 5/1958 | Lyon | 89/161 |
| 3,738,044 | 6/1973 | Robinson | 89/160 |
| 4,151,782 | 5/1979 | Allen | 89/155 |
| 4,375,136 | 3/1983 | Pedgonay | 89/163 |
| 5,284,081 | 2/1994 | Stoner et al. | 89/33.03 |

FOREIGN PATENT DOCUMENTS

| | | | |
|---|---|---|---|
| 8700613 | 1/1987 | WIPO | 89/157 |

*Primary Examiner*—Stephen M. Johnson
*Attorney, Agent, or Firm*—Ilya Zborovsky

[57] ABSTRACT

An automatic revolver has a body, a barrel arranged in the body and having an inner passage provided with a thread-like formation, an ammunition-containing element from which a bullet is displaced into the barrel, the barrel being turnable relative to the body so that when a bullet passes through the barrel and rotates in one direction, the barrels is rotated by a reactive moment in an opposite direction.

8 Claims, 1 Drawing Sheet

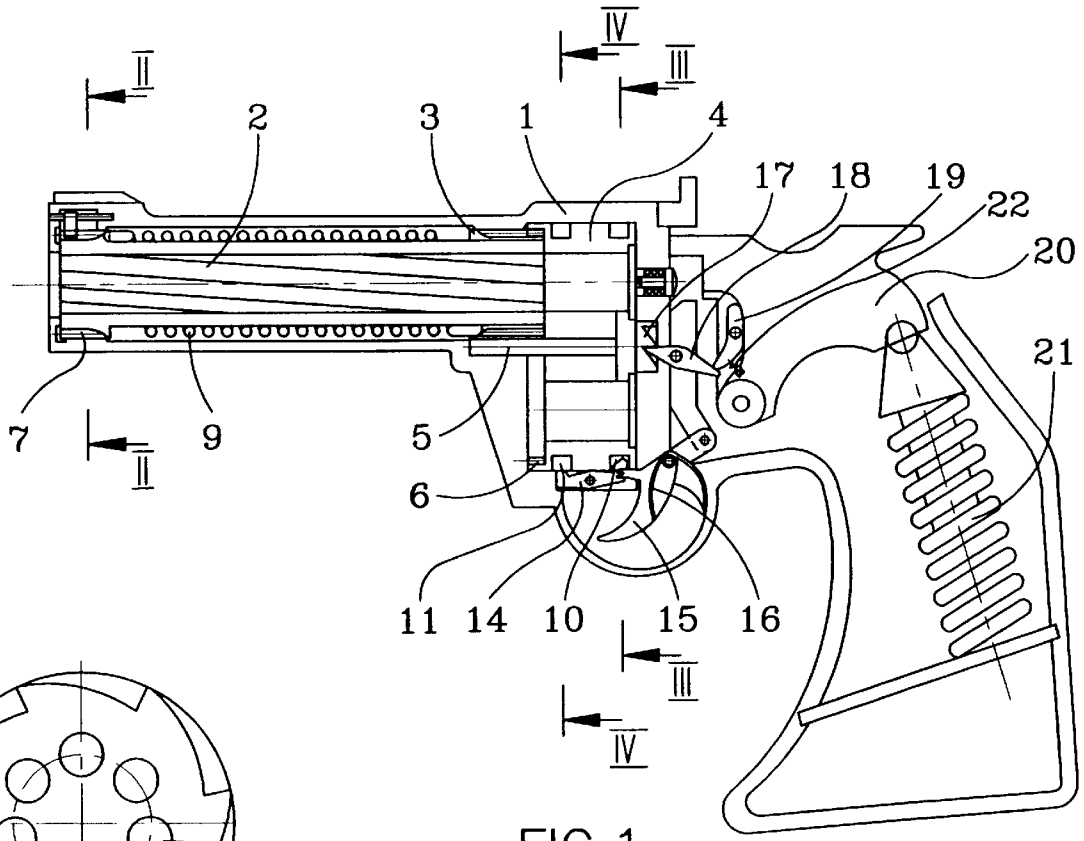
FIG. 1
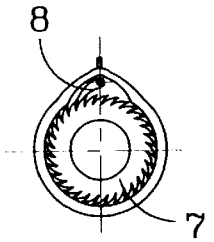
FIG. 2
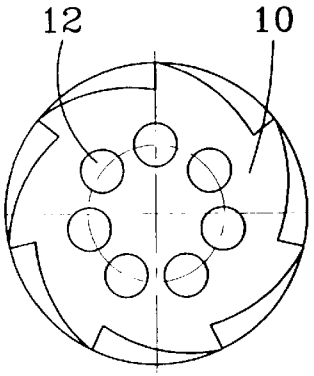
FIG. 4
FIG. 3

SEMI-AUTOMATIC REVOLVER

BACKGROUND OF THE INVENTION

The present invention relates to a personal weapon, such as revolvers, pistols, etc.

The present invention relates to a personal weapon, such as revolvers, pistols, etc.

Semi-automatic hand guns (pistols) are known and operate due to a reactive energy of powder gas. Extraction or discharge of a shell, withdrawal of a bullet from a clip, placement of the bullet into the bullet chamber, locking and cocking of a spring is performed during a reciprocal movement of the locking-striking mechanism. As a result, pistols have lower reliability when compared with revolvers. Moreover, during reloading of a pistol (exchange of the ammo clip) it is necessary to move the lock again. First it requires the use of both hands, and second increases the time needed to fire the weapon. If a misfire occurs, the possibility of an accident shot becomes very probable. Therefore, complicated safety systems are needed, with corresponding complicated and expensive parts. They delay the first shot and therefore reduce the value of the pistol as a means for self defense. Thus it is evident why the police of many countries, including our own, as well as detective and security agencies, until this day, utilize the revolver rather than the more modern pistol. However, semi-automatic hand guns exceed the revolver in their accuracy.

In the revolvers, the bullets are arranged in chambers of the drum and placed into a striking position by a ratchet mechanism as a result of pressing a trigger or cocking of a strike in revolvers of double or single action. The revolver mechanisms are simple and reliable. The use of the turning pairs, instead of sliding ones, eliminates clogging. In order to perform a next shot it is not necessary to extract the shells. In the event of a malfunction resulting from a defective bullet, the system does not need to be reloaded. In order to fire the next shot, one simply has to press the trigger. An accidental shot is completely excluded in the revolver systems. At the same time since the turning of the drum and cocking of a cock is performed manually, the force required on the trigger of a revolver is higher than in pistols, which in turn reduces the accuracy of as hot. The rate of fire in revolvers is also lower since the gas mechanism of the pistol is faster than the human finger. Due to the accuracy and high rate of fire of the semi-automatic hand guns, they almost completely replaced revolvers in the army.

In the revolvers, the bullets are arranged in chambers of the drum and displaced to a striking position by a ratchet mechanism as a result of pressing a trigger or caulking of a striker in revolvers of double or single action. The revolver mechanisms are simple and reliable. The use of turning pairs drastically eliminates clogging. In order to perform a next shot it is not necessary to extract the shells. In the event of malfunction as a result of a defective bullet, the system does not need a recharging. For displacement of a next bullet, it is necessary to press the trigger again. An accidental shot is completely excluded in the revolver systems. At the same time since the turning of the drum and caulking of a caulk is performed manually, the force required on the trigger of a revolver is higher than in the pistols, which in turn reduces the accuracy of shooting. The rate of shooting in the revolvers is also lower since the gas mechanism of the pistol is activated faster than the human finger. Due to the accuracy and high speed of shooting of the semi-automatic pistols, they completely replaced revolvers in the army.

SUMMARY OF THE INVENTION

Accordingly, it is an object of the present invention to provide a semi-automatic revolver which avoids the disadvantages of the prior art.

In keeping with these objects and with others which will become apparent hereinafter, one feature of the present invention resides, briefly stated in a semi-automatic revolver which has a body, a barrel arranged in the body and having an inner passage provided with a thread-like formation, a rotatable drum, and means for displacing a bullet from the drum into said barrel, the barrel being turnable relative to the body so that when a bullet passes through said barrel and rotates in one direction, the barrels is rotated by a reactive moment in an opposite direction.

When the semi-automatic revolver is designed in accordance with the present invention, it combines the advantages of a revolver such as its reliability in view of the use of only turning pairs, as well as a safety and permanent readiness for shooting of a fast-shooting pistol up to an automatic cycle, with an accuracy increasing the accuracy of each of these two types of weapons.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE DRAWINGS

FIG. 1 is a side view of a semi-automatic revolver in accordance with the present invention;

FIG. 2 is a view showing a cross-section taken along the line II—II in FIG. 1; and FIGS. 3 and 4 are views showing cross-sections taken along the lines III—III IV—IV in FIG. 1.

DESCRIPTION OF PREFERRED EMBODIMENTS

A revolver in accordance with the present invention has a body 1 with a threaded barrel 2, a toothed gear 3, and an ammunition-containing element formed as a drum 4 rotatable on an axle 5. A front part of the drum 4 is formed as a toothed gear 6 having inner teeth which engage with the teeth of the toothed gear 3. A front part of the barrel 2 is formed as a ratchet wheel 7 which engages with a pawl 8.

A torsion spring 9 is arranged on the barrel 2. It has one end connected with the barrel 2 and another end connected with a toothed gear 3 which freely rotates on the barrel 2. A peripheral region of the drum 4 is formed as two ratchet wheels 10 and 11 which have a number of teeth corresponding to a number of chambers 12. They are offset relative to one another by an angle which is equal to half angle between the chambers. A ratchet wheels 10 and 11 cooperate with a ratchet arm 14 which is activated by a trigger 15. The trigger hook 15 has a return spring 16. A ratchet cam 17 of the drum 4 cooperates with a lever 18 which in turn through a bar 19 acts onto a striker 20 connected with a striker spring 21.

In an initial position the chambers 12 of the drum are loaded, the ratchet arm 14 engages with the ratchet wheel 10 of the drum 4, which corresponds to a safe position of the drum 4. In this position, the axes of the striker 20 and the barrel 2 are located between two chambers 12 so as to prevent an accidental shot. The torsion spring 9 is preliminarily twisted. Therefore, it urges to turn the barrel 2 and the ratchet wheel 3 in opposite directions, so as to press the ratchet wheel 7 of the barrel 2 to the paws 8 on the one hand, and to press the ratchet wheel 10 of the drum to the ratchet arm 14 due to the engagement of the teeth of the toothed gears 3 and 6. The ratchet cam 17 presses the lever 18 against the bar 19. The striker 20 is located in a lowered position, and the spring 21 is expanded to a maximum extent.

When the trigger 15 is pressed, the arm 14 is turned, it disengages from the wheel 10 and engages with the wheel 11. The torsion spring 9 turns the drum for further until it contacts the ratchet wheel 11 with the arm 14. Thereby the axis of the chamber 12 with the bullet coincides with the axes of the barrel 2 and the striker 20. The ratchet cam 17 is turned together with the drum 4 and turns the lever 18 which through the bar 19, cocks the striker 20 and compresses the striking spring 21. In the moment when the ratchet wheel 11 is pressed to the arm 14, or in other words the axis of the chamber 12 coincide with the axes of the barrel 2 and the striker 20, the bar 19 jumps from the lever 18, the striking spring 21 is expanded, and the striker 20 strikes against a charge of the bullet. A shot is executed.

Due to the threads in the barrel 2, the bullet during movement in the barrel obtains a rotary motion. In view of the law of preservation of moments, a reactive moment is generated in the barrel 2 and tries to turn the barrel 2 in direction which is opposite to the direction of turning of the bullet. The barrel 2 is turned and twists the spring 9 so as to tension the spring. When the trigger is released, the ratchet arm 14 disengages the ratchet wheel 11 and engages the ratchet wheel 10. The drum 4 is now turned by the spring 9 which is relaxing through the toothed gears 3 and 6, so as to assume again a next safe position, ready for a next shot.

It will be understood that each of the elements described above, or two or more together, may also find a useful application in other types of constructions differing from the types described above.

While the invention has been illustrated and described as embodied in semi-automatic revolver, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

We claim:

1. An automatic revolver, comprising a body; a barrel arranged in said body and having an inner passage provided with a thread-shaped formation; an ammunition-containing element from which a bullet is displaced into said barrel, said barrel being turnable relative to said body so that when a bullet passes through said barrel and rotates in one direction, said barrel is rotated by a reactive moment in an opposite direction.

2. An automatic revolver as defined in claim 1; and further comprising means for connecting said barrel which said ammunition-containing element, so that the turning of said barrel causes a movement of said ammunition-containing element to a next position ready for a next shot.

3. An automatic revolver as defined in claim 2, wherein said ammunition-containing element is formed as a turnable drum, said connecting means being formed so that the turning of said barrel causes a turning of said drum to the next position ready for the next shot.

4. An automatic revolver as defined in claim 3, wherein said connecting means include a spring connected with said barrel and said drum so that during shooting and turning of said barrel said spring is tensioned by the turning of said barrel, and after the shooting said spring is relaxed and turns the drum to the next position ready for the next shot.

5. An automatic revolver as defined in claim 4, wherein said spring is a tension spring.

6. An automatic revolver as defined in claim 1, wherein said barrel has a part formed as a ratchet wheel, said body carrying a ratchet pawl engaging with said ratchet wheel.

7. An automatic revolver as defined in claim 3, wherein said drum has a plurality of chambers and a peripheral region formed as two ratchet wheels having a number of teeth equal to a number of said chambers and offset relative to one another by an angle equal to a half angle between said chambers.

8. An automatic revolver as defined in claim 7; and further comprising a ratchet arm engaging said ratchet wheels; and a trigger which activates said ratchet arm.

* * * * *